United States Patent [19]

Ishida

[11] Patent Number: 4,661,428

[45] Date of Patent: Apr. 28, 1987

[54] COMPOSITE PHOTOSENSITIVE ELEMENTS FOR USE IN ELECTROPHOTOGRAPHY AND PROCESS OF FORMING IMAGES USING SAME

[75] Inventor: Tsutomu Ishida, Tokyo, Japan

[73] Assignee: Ricoh Co., Ltd., Tokyo, Japan

[21] Appl. No.: 528,665

[22] Filed: Sep. 1, 1983

Related U.S. Application Data

[63] Continuation of Ser. No. 337,211, Jan. 5, 1982, abandoned.

[30] Foreign Application Priority Data

Jan. 14, 1981 [JP] Japan ..... 56-4260
Jan. 24, 1981 [JP] Japan ..... 56-9248

[51] Int. Cl.[4] ..... G03G 5/082; G03G 5/14

[52] U.S. Cl. ..... 430/58; 430/57; 430/85; 430/86

[58] Field of Search ..... 430/57, 58, 59, 85, 430/86

[56] References Cited

U.S. PATENT DOCUMENTS 2,803,541 8/1957 Paris ..... 430/57
2,803,542 8/1957 Ulrich ..... 430/85 X
3,655,377 4/1972 Sechak ..... 430/57
3,704,121 11/1972 Makino et al. ..... 430/57 X
4,066,455 1/1978 Mey et al. ..... 430/59
4,296,191 10/1981 Jacobson et al. ..... 430/57
4,335,194 6/1982 Sakai ..... 430/46 X

FOREIGN PATENT DOCUMENTS 1408207 10/1975 United Kingdom ..... 430/86

*Primary Examiner*—Roland E. Martin
*Attorney, Agent, or Firm*—Flynn, Thiel, Boutell & Tanis

[57] ABSTRACT

A composite photosensitive element for use in electrophotography which comprises an electrically conductive substrate and a first photoconductive layer and second photoconductive layer laminated on said substrate in the order named, said first photoconductive layer being a Se-As vapordeposited layer or a Se-Te-As vapordeposited layer, said second photoconductive layer being a multilayer type one comprising a charge transport layer and a charge carrier generating layer consisting essentially of azo pigment in the order named from the surface and a process of forming images using same.

6 Claims, 7 Drawing Figures

COMPOSITE PHOTOSENSITIVE ELEMENTS FOR USE IN ELECTROPHOTOGRAPHY AND PROCESS OF FORMING IMAGES USING SAME

This application is a continuation of U.S. Ser. No. 337,211 filed Jan. 5, 1982, now abandoned.

BACKGROUND OF THE INVENTION (1) Field of the invention

The present invention relates to a composite photosensitive element for use in electrophotography and a process of forming images, in particular a composite photosensitive element for use in electrophotography capable of achieving a dichromatic reproduction even from a multi-color original by a single exposure step not to mention a monochromatic (black and white) reproduction and a dichromatic reproduction process using same.

(2) Description of the prior art

As the prior art electrophotography there is well known one designed so as to form two electrostatic latent images having a polarity opposite to each other which comprises sensitizing a photosensitive element consisting of an electrically conductive substrate and two photoconductive layers, laminated thereon, whose photosensitive wavelength range is different from each other, by subjecting said element to a primary charge and a secondary charge of a polarity opposite to the former and exposing a different colored original image simultaneously or successively under this state.

As the original used herein there is normally enumerated one having a black and chromatic (A) image on a white ground (background area), wherein said chromatic (A) is mostly red. Accordingly, in the case of the photosensitive element of this sort, the one photosensitive layer is made of a material having a sensitivity to the chromatic light (A) and the other photosensitive layer is made of a material which has no sensitivity to the chromatic light (A) or may be made of a raw material having a sensitivity to the chromatic light (A) on condition that a filter layer is provided.

As the photosensitive element (composite element for use in electrophotography) as mentioned above, there has been proposed a photosensitive element wherein a photosensitive layer (second photosensitive layer) more remote from an electrically conductive substrate is used as a layer having a sensitivity to said chromatic light (A), said second photosensitive layer comprising the lamination of a relatively thin charge carrier generating layer and a relatively thick charge transport layer.

In other words, as one of the typical photosensitive elements of this type there is well known a photosensitive element wherein a first photoconductive layer (contacting directly on an electrically conductive substrate) is formed as an amorphous vapordeposited layer of Se or Se-Te alloy or a laminated layer (Se/SeTe) comprising a Se vapordeposited layer and a Se-Te vapor-deposited layer laminated thereon as a sensitizing layer, while a second photoconductive layer consists essentially of azo pigment. The composite photosensitive element of this sort is characterized in that the less the electric potential of the first photoconductive layer decays at the time of exposure to a red color in the reproduction process, the higher the density of a reproduced copy is.

However, this conventional composite photosensitive element is defective in that the Se layer or the Se/SeTe laminated layer has a sensitivity even to a long wavelength more than about 700 nm due to the presence of crystalline Se, and therefore only the second photoconductive layer or the filter effect of copper phthalocyanine added to an intermediate layer provided in case of need can not prevent the electric potential drop at the time of exposure to a red color completely or almost completely. The red color in "the time of exposure to a red color" means a light having a spectral distribution only in the range of 560–600 nm or more.

Accordingly, when it is absolutely required that the first photoconductive layer should scarcely have a sensitivity to radiation of the above mentioned red light, said requirement may be satisfied by the ways of (a) selectively finding the materials for use in the first photoconductive layer which have a sensitivity to only the wavelength range less than the above defined one and (b) increasing the red color cutting faculty of the intermediate layer by adding much more of blue pigment such as copper phthalocyanine or the like or blue dye to the intermediate layer. In this connection, it is to be noted that FIG. 5 illustrates the spectral permeability of the intermediate layer added with copper phthalocyanine. It may be understood from this graph that in the above mentioned (b) the first photoconductive layer may have a sensitivity to the range of 600–700 nm. However, this composite photosensitive element also involves undesirable aspects that the selection of raw materials as mentioned in the preceding (a) is not necessarily easy, and in the preceding (b) the quantity of light reaching the first photoconductive layer is reduced largely and consequently the residual potential is increased.

The fact is that Se or SeTe alloy has been considered to be adaptable for the first photoconductive layer of the photosensitive element for use in dichromatic reproduction as described above, since the durability of the Se photosensitive element is superior more than any other inorganic or organic photosensitive elements at the present stage, the sensitivity of simple substance Se (non-crystalline Se) is mainly in the range of less than 560 nm, and further the total sensitivity or spectral permeability of the element may be changed relatively easily by laminating the SeTe sensitizing layer on the Se layer as mentioned above and regulating the content of Te. In spite of this, the use of the Se layer or Se/SeTe laminated layer as the first photoconductive layer was found undesirable in the following points that it sometimes produced good results and sometimes produced bad results and consequently the produced composite photosensitive elements per se were extremely unbalanced in the quality and unreliable. This unbalanced quality is considered to result from that the degree of crystallization of selenium or selenium-tellurium alloy changes depending on the conditions under which said metal or alloy is vapordeposited.

SUMMARY OF THE INVENTION

The inventor has carried out various experiments and investigations on the composite photosensitive elements as mentioned above to find that the employment of the vapordeposited layer of Se-As alloy or Se-Te-As alloy as the first photoconductive layer can prevent the occurrence of the above mentioned defects or undesirable phenomena and can maintain the red color potential after imagewise exposure (light image radiation) at an especially high level, whereby there can be obtained high quality dichromatic copies. The present invention has been completed on the basis of this finding.

One object of the present invention is to provide a composite photosensitive element for use in electrophotography which is capable of obtaining stable and high quality dichromatic copies without resulting in the above mentioned defects or improprieties and a process of forming images using same. Another object of the present invention is to provide a composite photosensitive element for use in electrophotography which can be produced without taking care of especially strict conditions.

In other words, the present invention relates to a composite photosensitive element for use in electrophotography capable of forming heteropolar electrostatic latent images which comprises an electrically conductive substrate, a first photoconductive layer, an intermediate layer, including an intermediate electric current controlling layer, if necessary, and a second photoconductive layer laminated on said substrate in the order named, characterized in that said first photoconductive layer is a Se-As vapordeposited layer or a Se-Te-As vapordeposited layer and said second photoconductive layer is a multilayer type one comprising a charge transport layer and a charge carrier generating layer consisting essentially of azo pigment in the order named from the surface.

In the above layer-structured photosensitive element according to the present invention, the first photoconductive layer has the property of having no sensitivity especially to a red light as well as accepting the injection of the charge of positive polarity at the time of electrification, while the second photoconductive layer has the property of having a sensitivity especially to a red light.

Accordingly, the process of forming images (process of obtaining dichromatic copies) according to the present invention is characterized by comprising the steps of subjecting the above mentioned photosensitive element to a negative first electrification in the dark utilizing the specific property of the said element, subsequently subjecting the thus treated photosensitive element to a positive or alternating current second electrification likewise in the dark (the second electrification in this case is effected in a quantity less than that of the first electrification), thereafter subjecting the photosensitive element in this state to imagewise exposure through a dichromatic original having black and red areas to thereby form on the photosensitive element an electrostatic latent image corresponding to the black area and red area of the original and having a negative surface potential at the area corresponding to the black area of the original and a positive surface potential at the area corresponding to the red area of the original, successively developing the resulting electrostatic latent image with toners opposite in polarity and different in color, for instance, such as red toner of negative polarity and a black toner of positive polarity to thereby obtain a dichromatic visible image (toner image), and fixing this toner image as it is or transferring this toner image onto an image receiving material such as a paper, a synthetic paper, a resin film or the like and fixing. The photosensitive element after transfer goes through the treating steps of cleaning, removing of electricity and the like and is again put to the reproduction cycle including the first electrification and successive steps as mentioned above.

Figure 1:
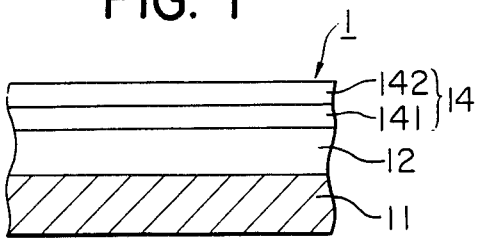
FIGS. 1 to 4 are cross-sectional views illustrating four embodiments of the composite photosensitive element according to the present invention.

In these figures, reference numerals 1, 1′, 1″ and 1‴ each denotes a photosensitive element (a composite photosensitive element for use in electrophotography). Reference numeral 11 denotes an electrically conductive substrate. Reference numeral 12 denotes a first photoconductive layer. Reference numeral 13 denotes an intermediate layer (an intermediate electric current controlling layer). Reference numeral 14 denotes a second photoconductive layer. Reference numeral 121 denotes a Se-As vapordeposited layer. Reference numeral 122 denotes a Se-Te vapordeposited sensitizing layer. Reference numeral 141 denotes a charge carrier generating layer. Reference numeral 142 denotes a charge transport layer. Reference numeral 2 denotes an original. Reference numerals 31 and 32 each denotes a toner.

DESCRIPTION OF THE PREFERRED EMBODIMENTS OF THE INVENTION

Figure 2:
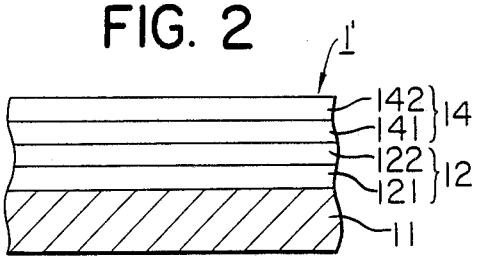
Figure 4:
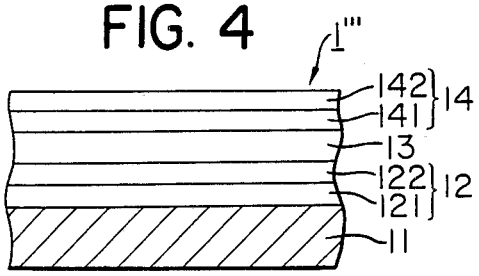
Figure 6A:
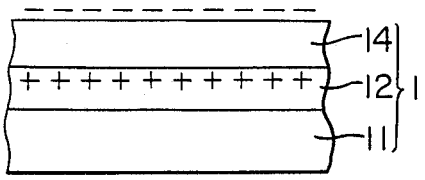
FIGS. 6 and 7 are views explaining the electrophotography (process of forming images) using the composite photosensitive element according to the present invention.
Figure 6B:
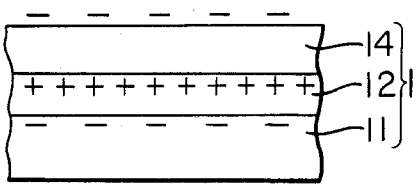
Figure 6C:
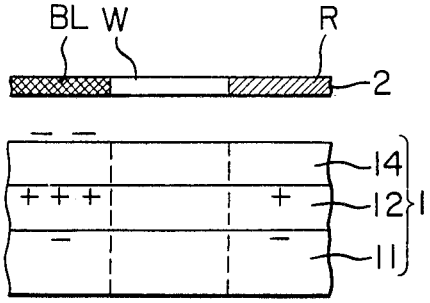
Figure 6D:
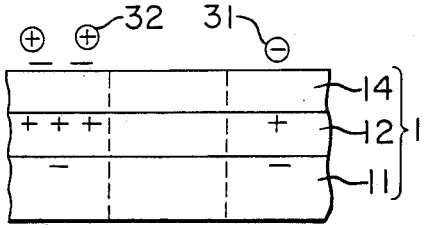
Figure 5:
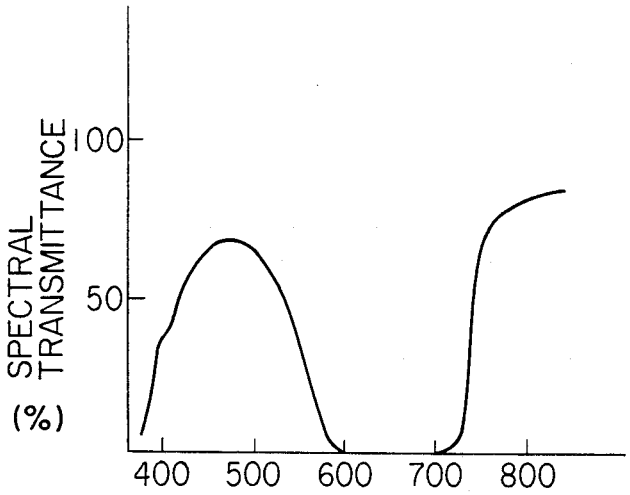
FIG. 5 is a graph showing the spectral permeability of an about 1 μm-thick resin layer (filter layer) prepared by dispersing β-copper phthalocyanine in the percentage of 35% by weight in a resin (polyester resin).

As will be evident from the accompanying drawing, the intermediate layer (the intermediate electric current controlling layer) 13 of the photosensitive element according to the present invention is one to be provided on the occasion of necessity. And, the Se-Te vapordeposited sensitizing layer 122 is also one to be provided as occasion demands. In this connection, it is to be noted that this Se-Te vapordeposited sensitizing layer 122, as seen from FIG. 2 and FIG. 4, is provided as occasion demands only when the first photoconductive layer 12 is consisted of the Se-As vapordeposited layer 121, and so there is no necessity of providing the Se-Te vapor-evaporated sensitizing layer when the first photoconductive layer 12 comprises the Se-Te-As vapordeposited layer. Further, the second photoconductive layer 14 comprises a double layer consisting of the charge carrier generating layer (CGL) 141 and the charge transport layer (CTL) 142.

As the electrically conductive substrate 11 there can be enumerated a plate or cylindrical body made of a conductive metal whose volume resistivity is $10^{10}$ Ωcm or less such as Al, Cu, Pb or the like, a plate or cylindrical body made of a metal oxide such as $SnO_2$, $In_2O_3$, CuI, $CrO_2$ or the like, or a plastic film (for instance, a polyester film), paper, cloth or the like on which said metal or metal oxide has been coated by vapordeposition or sputtering.

Figure 3:
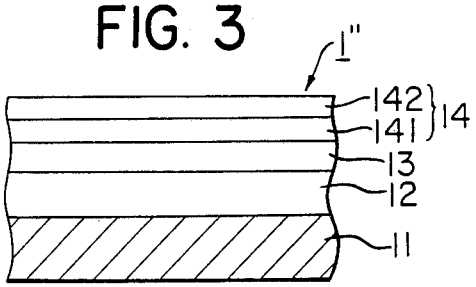

There are two cases where the first photoconductive layer 12, as shown in FIG. 1 and FIG. 3, comprises only the Se-As alloy vapordeposited layer or the Se-Te-As alloy vapordeposited layer and, as shown in FIG. 2 and FIG. 4, comprises the lamination of the Se-Te vapordeposited sensitizing layer 122 on the Se-As alloy vapordeposited layer 121. In this case, the Se-As alloy vapor-deposited layer 12 is identical with the Se-As alloy vapor-deposited layer 121.

The preferable quantity of As contained in the Se-As alloy vapordeposited layer 12 (or 121) is 1-6% by weight. The amorphous Se photosensitive element is generally considered to have the peak of its spectral sensitivity in the vicinity of 700 nm due to presence of another Se crystal. However, the addition of As to the Se photosensitive element seems to prevent the crystallization of Se and thus restrain the sensitivity of said element to a red color. In view of this, when the quantity of As added is less than 1% by weight, the above mentioned effect can not be exhibited to the full and when the quantity of As added is over 6% by weight in contrast with this, the addition of As promotes the tendency of extending the spectral sensitivity to the long wavelength side and produces an adverse result.

When the Se-Te vapordeposited sensitizing layer 122 is laminated on the Se-As vapordeposited layer 121 as shown in FIG. 2 and FIG. 4, the above mentioned effect is more enhanced. The suitable quantity of Te contained in the Se-Te vapordeposited layer 122 is in the range of 4-12% by weight. In other words, the lamination of this Se-Te vapordeposited sensitizing layer 122 causes the first photoconductive layer 12 to exhibit scarce sensitivity to a red light.

The Se-As vapordeposited layer 12 (or 121) is formed by vacuum-vapordepositing the Se-As alloy (whose As content is 1-6% by weight) at the vapordeposition source temperature of 330°-380° C.. and the substrate temperature (the supporting temperature of the substrate) of 80°-120° C. The suitable thickness of this layer is about 20-40 μm. And, the Se-Te vapordeposited sensitizing layer 122 is formed by vacuum-vapordepositing the Se-Te alloy (whose Te content is 4-12% by weight) at the vapordepositing temperature of 300°-350° C. and the substrate temperature (the supporting temperature of the structure formed by laminating the Se-As vapordeposited layer 121 on the electrically conductive substrate 11) of 50°-70° C. The suitable thickness of this layer 122 is about 0.5-5 μm.

On the other hand, when the first photoconductive layer 12 comprises the Se-Te-As alloy vapordeposited layer, the suitable quantities of Te and As contained in this alloy component are 4-12% by weight and 1-4% by weight respectively. This vapordeposited layer can be formed by vacuum-vapordepositing the above mentioned alloy at the vapordeposition source temperature of 330°-380° C. and the substrate temperature (the supporting temperature of the electrically conductive substrate 11) of 80°-120° C. The thickness of this Se-Te-As alloy vapordeposited layer, i.e. the first photoconductive layer is about 20-50 μm and this layer acquires the property of exhibiting scarce sensitivity to a red light.

The second photoconductive layer 14, as previously stated, comprises a double layer consisting of the charge carrier generating layer (CGL) 141 and the charge transport layer (CTL) 142. And, the CGL 141 is consisted essentially of azo pigment (charge carrier generating azo pigment). As this photoconductive organic pigment there can be enumerated the carbazole skeleton-having azo pigment (disclosed in Japanese Laid-open Patent Application No. 95033/1978), the styrylstilbene skeleton-having azo pigment (disclosed in Japanese Laid-open Patent Application No. 133229/1978), the tripenylamine skeleton-having azo pigment (disclosed in Japanese Laid-open Patent Application No. 132547/1978), the dibenzothiophene skeleton-having azo pigment (disclosed in Japanese Laid-open Patent Application No. 21728/1979), the oxadiazole skeleton-having azo pigment (disclosed in Japanese Laid-open Patent Application No. 12742/1979), the fluorenone skeleton-having azo pigment (disclosed in Japanese Laid-open Patent Application No. 22834/1979), the bisstilbene skeleton-having azo pigment (discosed in Japanese Laid-open Patent Application No. 17733/1979), the distyryloxadiazole skeleton-having azo pigment (disclosed in Japanese Laid-open Patent Application No. 2129/1979), the distyrylcarbazole skeleton-having azo pigment (disclosed in Japanese Laid-open Patent Application No. 17734/1979) or the like.

This CGL 141 is formed by making the above enumerated azo pigment into a thin film by means of vapordepositing or sputtering method or by coating a dispersion or solution of said azo pigment together with a binder resin in a solvent and drying. The ratio of binder resin/azo pigment is about 0/1-3/1 by weight. And, the suitable thickness of the CGL 141 is about 0.01-1 μm. When this thickness is less than 0.01 μm the charge carrier generating operation is deteriorated. In contrast with this, even when thickened more than 1 μm, it does not answer the expectation of increased effect and it is apt to entail the danger of blocking the permeation of sufficient light onto the first photoconductive layer 12.

As the binder resins used herein there can be enumerated polyethylene, polystyrene, polybutadiene, styrene-butadiene copolymers, polymers of acrylic esters or methacrylic esters and copolymers containing monomers thereof, polyester resin, polyamide resin, polycarbonate resin, epoxy resin, urethane resin, silicone resin, alkyd resin, cellulosic resins and poly-N-vinylcarbazole and derivatives thereof (for instance, those having halogens such as chlorine and bromine and substituted radicals such as methyl, amino and the like in the carbazole skeleton), polyvinylpyrene, polyvinylanthracene, pyrene-formaldehyde condensation polymers and derivatives thereof (for instance, those having halogens such as bromine and the like and substituted radicals such as nitro and the like in the pyrene skeleton), poly-Y-carbazolyl ethyl-L-glutamates, styrol resin, chlorinated polyethylene, acetal resin, melamine resin and the like.

These binder resins may be used together with plasticizers. Plasticizers suitably used in the present invention include those which have generally been used for resins, for instance, such as dibutyl phthalate, dioctyl phthalate and the like. The quantity of said plasticizer used in suitably in the range of 0-30% by weight against the associated binder resin.

The CTL 142 is formed by coating the surface of the CGL 141 with a dispersion or solution of an electron donability organic substance (electron donor) together with a binder resin as occasion demands in a solvent and drying. The binder resin used herein as occasion demands and the plasticizer added thereto are the same as described already with reference to the formation of the CGL 141. In this case, the weight ratio of binder resin/electron donability substance is about 0/1-4/1, and the suitable thickness of the CTL 142 is about 10-30 μm. When the thickness deviates from this range there take place undesirable results. That is, when the thickness is less than 10 μm, the charge preservation is insufficient, while when the thickness is over 30 μm, it causes undesirable results because the potential differentials between the red area and the black are is thereby lessened.

The electron donability substance includes compounds containing at least one group selected from an alkyl group such as methyl group or the like, an alkoxy group, an amino group, an imino group and an imido group; or compounds having, at the main chain or side chain, polycyclic aromatic compounds such as anthracene, pyrene, phenanthrene, coronene, etc. or nitrogen-containing cyclic compounds such as indole, carbazole, oxazole, isooxazole, thiazole, imidazole, pyrazole, oxadiazole, thiadiazole, thiazole, etc.

As low molecular weight electron donability substances there can be enumerated hexamethylenediamine, N-(4-aminobutyl)cadaverine, as-didodecylhydrazine, p-toluidine, 4-amino-o-xylene, N-N'-diphenyl-1,2-diaminoethane, o, m- or p-ditolylamine, triphenylamine, tetraphenylmethane, durene, 2-bromo-3,7-dimethylnaphthalene, 2,3,5-trimethylnaphthalene, N'-(3-bromophenyl)-N-(α-naphthyl)urea, N-N'-diethyl-N-(α-naphthyl)urea, 2,6-diethylanthracene, anthracene, 2-phenyl anthracene, 9,10-diphenylanthracene, 9,9'-bianthracene, 2-dimethylaminoanthracene, phenanthrene, 9-aminophenanthrene, 3,6-dimethylphenanthrene, 5,7-dibromo-2-phenylindole, 2,3-dimethylindoline, 3-indolylmethylamine, carbazole, 2-methylcarbazole, N-ethylcarbazole, 9-phenylcarbazole, 1,1'-dicarbazole, 3-(p-methoxyphenyl)oxazolidine, 3,4,5-trimethylisooxazole, 2-anilino-4,5-diphenylthiazole, 2,4,5-triaminophenylimidazole, 4-amino-3,5-dimethyl-1-phenylpyrazole, 2,5-diphenyl-1,3,4-oxadiazole, 1,3,5-triphenyl-1,2,4-triazole, 1-amino-5-phenyltetrazole, bis(diethylaminophenyl)-1,3,6-oxadiazole, 1,3-diphenyl-2-p-diethylaminophenyltetrahydroimidazole, bis[p-(N,N-dibenzyl)aminophenyl]methane, 1,1-bis[p-(N,N-dibenzyl)aminophenyl]propane, 4,4'-bis(diethylamino)-2,2'-dimethyltriphenylmethane, 4,4'-bis(diethylamino)-2,2'-dimethyl-2''-chlorotriphenylmethane, α,α-bis(2-methyl-4-diethylaminophenyl)-2-methylthiophene, α,α-bis (2-methyl-4-diethylaminophenyl)-2-picoline, α,α-bis(2-methyl-4-diethylaminophenyl)-2-methylfuran, α,α-bis(2-methyl-4-diethylaminophenyl)-2-methylpyrrole, α,α-bis(2-methyl-4-diethylaminophenyl)-2-methylindole, α,α-bis(2-methyl-4-diethylaminophenyl)-2-methylbenzothiophene, α,α-bis(2-methyl-4-diethylaminophenyl)-2-methylbenzofuran, 4,4',4''-tris(diethylamino)-2,2'-dimethyltriphenylmethane and the like.

Further, as high molecular weight electron donability substances there can be enumerated poly-N-vinylcarbazole and its derivatives (for example, those having halogen such as chlorine, bromine and the like and substituents such as methyl group, amino group, etc. at the carbazole skeleton), polyvinylpyrene, polyvinylanthracene, pyrene-formaldehyde condensation polymer and its derivatives (for example, those having halogen such as bromine or the like and substituents such as nitro group, etc. at the pyrene skeleton).

Of these electron donability substances, a low molecular weight one can be used together with a binder resin, while a high molecular weight, which is itself adhesive, can dispense with the concurrent use of a binder resin.

The second photoconductive layer 14 is composed of a double layer of the CGL 141 consisting essentially of azo pigment and CTL 142 as mentioned above, and this layer exhibits a high sensitivity especially to a red light.

The intermediate layer 13, including the intermediate electric current controlling layer, is provided when necessary.

This intermediate electric current controlling layer 13 is effective especially when the second electrification is conducted with an alternating current. The intermediate layer provided between the first photoconductive layer and the second photoconductive layer is normally effective for the purpose of preventing the leakage of electric charge, too. In other words, the intermediate layer plays an important role in the capture and release of electric charge at the boundary surfaces between the intermediate layer and the photoconductive layers.

The intermediate electric current controlling layer 13 of the present invention is necessary to have a commutating ability when the second electrification is conducted with an alternating current. In other words, the intermediate electric current controlling layer 13 has the property of preventing the transfer of plus electric charge but permitting the transfer of minus electric charge in the dark. For this purpose, the intermediate layer (including the intermediate electric current controlling layer) 13 is formed with an organic material such as resin or the like or an inorganic material such as silicon oxide, magnesium fluoride or the like. The intermediate electric current controlling layer 13 (including the mere intermediate layer like the conventional one which is prepared if circumstances require) is formed with these materials in the manner to be enumerated hereinafter:

(a) the organic material soluble in a solvent such as polyester resin, urethane resin, phenol resin or the like is solved in a solvent so as to have a weight concentration of about 5–20%. The resulting solution is coated by blade or dipping method and dried. In this case, polymerization or hardening may be promoted by radiation of ultraviolet ray.

(b) in the case of a film made by polymerizing the material such as polyethylene resin, fluorine resin or the like insoluble in an organic solvent, this film may be laminated on the first photoconductive layer by means of a bonding agent such as a resin soluble in a solvent and the second photoconductive layer may be formed on this film.

(c) in the case of polyxylene which can form a film during polymerization, it may be polymerized directly on the first photoconductive layer, and (d) in the case of inorganic materials or some of the organic materials such as fluorine resin and the like, a film may be formed by using vacuum-vapordeposition or sputtering method.

The suitable thickness of the intermediate layer 13 is about 0.3–3 μm. Further, this layer 13 may be made so as to have an optical filtering function in case of necessity. That is, in order that a red light is cut completely or almost completely from the light permeating through the layer 13 and reaching the first photoconductive layer, the following measure may be employed: (i) the azo pigment used in the CGL 141 or another cyan coloring matter (pigment or dye) is dispersed in the layer 13 or (ii) the layer 13 is formed as a three layer-type one by forming on the intermediate layer 13 a film of the azo pigment or another cyan coloring matter using vapordeposition or sputtering method and further forming thereon the intermediate layer 13.

The above mentioned "another cyan coloring matter" includes:

(a) Cyanine coloring matters such as
3,3'-diethyl-2,2'-thiacarbocyanineiodide,
3,3'-diethyl-9,11-neopentylene-2,2'-thiadicarbocyanineiodide,
3,3'-diethyl-2,2'-oxatricarbocyanineiodide,
1,1'-diethyl-4,4'-quinocarbocyanineiodide, 1,1'-diethyl-11-bromo-2,2'-quinodicarbocyaninebromide, 1,1'-diethyl-11-chloro-2,2'-quinodicarbocyaninebromide, 3,3'-diethyl-2,2'-thiatricarbocyaninebromide, 1-1', 1''-triethyl-11-(4''-quinolyl)-4,4'-quinodicarbocyaninediiodide, 2-{[3-ethyl-5-(1-ethyl-4-quinolinidene)-ethylidene-4-oxy-2-thiazolinidene]-methyl}-3-ethyl-4,5-diphenylthiazoliumbromide;

(b) Triphenylmethane dyes such as Bromochlorophenol Blue, Bromocresol Blue, Bromocresol Green, Bromocresol Purple, Bromophenol Blue, Na salt of bromophenol blue, erioglaumine, Methyl Blue, Methyl Violet, Na salt of tetrabromophenol blue; and (c) Indigo Blue, Methylene Blue, phthalocyanine non-substituted by metal or substituted by copper, cobalt, chromium, zinc, manganese, iron, lead, nickel, silver, tin, aluminum, etc. or chlorinated phthalocyanine.

In the practical preparation of the photosensitive element according to the present invention, it may be obtained by laminating, on the electrically conductive substrate 11, the first photoconductive layer 12, the intermediate layer 13 to be provided when necessary, and the second photoconductive layer 14 comprising the CGL 141 and CTL 142 in the order named. In the course of preparation of this photosensitive element, special attention should be paid to the kind of alloy to be used in the first photoconductive layer 12 and the percentages of components of the alloy used.

As previously stated, the first photoconductive layer 12 (the Se-As vapordeposited layer 121 in the case of the photosensitive element illustrated in each of FIGS. 2 and 4) comprises an evaporated layer of Se-As alloy or Se-Te-As alloy. In this case, the quantity of As contained in the Se-As alloy vapordeposited layer should be in the range of 1–6% by weight. When the As content is in the excess of 6% by weight, as previously stated, the enhanced spectral sensitizing range exerts a bad result adversely, and at the same time the efficiency of accepting the injection of charge from the hole electrode (electrically conductive substrate 11) is also deteriorated at the time of the first electrification.

On the other hand, when the first photoconductive layer 12 is a vapordeposited layer of Se-Te-As alloy (wherein the Te content is 4–12% by weight), the As content should be in the range of 1–4% by weight. When the As content is in excess of 4% by weight, as in the case of the above mentioned Se-As alloy, the enhanced spectral sensitizing range exerts a bad effect adversely and at the same time the efficiency of accepting the injection of hole charge from the electrically conductive substrate 11 is also deteriorated at the time of the first electrification.

In this connection, it is to be noted that it is also effective for the purpose of reducing the hole trap of the first photoconductive layer 12 to incorporate chlorine in the Se-As alloy or Se-Te-As alloy or in the Se-Te alloy beforehand in the range of about 100 ppm or less.

The organic solvent suitably used in the course of preparation of the photosensitive element of the present invention, as a matter of course, must be one capable of dissolving a binder, for instance, such as toluene, tetrahydrofuran, 1,2-dichloroethane, benzene, methanol or the like.

In the thus prepared composite photosensitive element for use in electrophotography 1 (or 1', 1'' or 1'''), the first photoconductive layer 12 has the property of having no sensitivity especially to a red light as well as accepting the injection of the charge of positive polarity, while the second photoconductive layer 14 has the property of having a sensitivity especially to a red light.

Accordingly, in order to obtain a dichromatic image using this photosensitive element (explanation will be made for convenience' sake with reference to the photosensitive element 1 illustrated in FIG. 1 because photosensitive elements, 1, 1', 1'' and 1''' give the same performances), said photosensitive element is subjected to a negative first electrification in the dark (FIG. 6(*a*)). Subsequently, this photosensitive element is subjected to a positive or alternating current second electrification likewise in the dark. In this case, the second electrification is carried out in a quantity less than that of the first electrification (FIG. 6(*b*)). Thereafter, the light image of an original 2 is radiated onto the photosensitive element in this state, with the results that the charge distribution of the photosensitive element corresponding to the black area BL of the original remains unchanged but the charge distribution thereof corresponding to the white area W of the original disappears because both the first photoconductive layer 12 and the second photoconductive layer 14 become electrically conductive. On the other hand, with reference to the charge distribution of the photosensitive element corresponding to the red area R of the original 2, no charge remains on the second photoconductive layer 14 because it becomes electrically conductive, but charge remains partly on the first photoconductive layer (FIG. 6(*c*)).

Thus, on each photoconductive layer of the photosensitive element 1 there is formed an electrostatic latent image corresponding to the black area and red area of the original as well as being opposite in polarity to each other (in other words, an electrostatic latent image having a negative surface potential at the area of the photosensitive element corresponding to the black area of the original and a positive surface potential at the area of the photosensitive element corresponding to the red area of the original). This electrostatic latent image is developed in succession with a negative red toner 31 and a positive black toner 32, whereby there is obtained a dichromatic visible image (toner image) (FIG. 6(*d*)). A dichromatic copy may be obtained by fixing this toner image as it is or transferring this toner image onto a paper or the like and fixing. In this connection, FIG. 7 illustrates the surface potential conditions of the photosensitive element with the lapse of time throughout this process.

Figure 7:
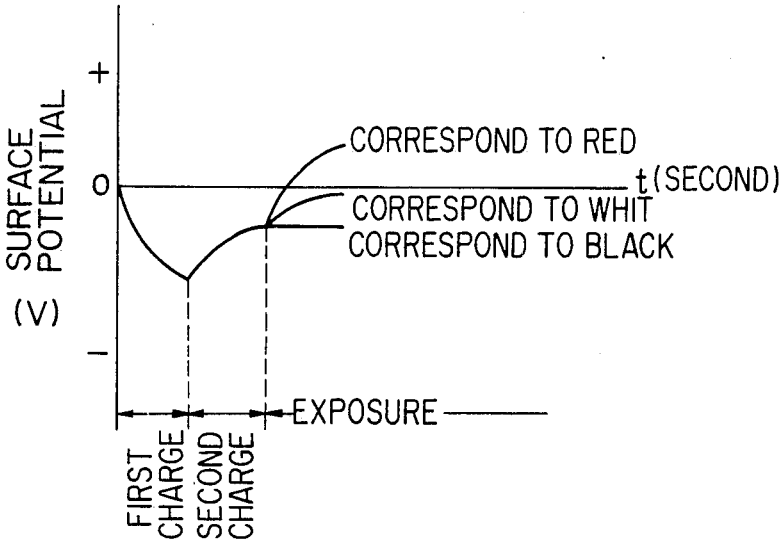

The photosensitive element according to the present invention is applicable not only to the processes illustrated in FIGS. 6 and 7 but also to the conventional Carlson process. The original is not limited to a dichromatic one, but may be a multi-colored one. By using this multi-colored original there can be reproduced the respective chromatic areas with an excedingly conspicuous disparity in image density.

EXAMPLES

Example 1

An about 43 μm-thick Se-As layer was formed by vacuum-depositing a Se-As alloy (whose As content is 3% by weight) on a 0.2 mm-thick Al plate (electrically conductive substrate) held at 80° C. from a vapordeposition source maintained at 320° C. for 25 minutes. A Se-Te alloy (whose Te content is 10% by weight) was vapordeposited on this Se-As layer held at 70° C. so as to attain a thickness of about 3 μm to thereby form a sensitizing layer. Thus, there was prepared a first photoconductive layer laminated on the electrically conductive substrate.

Subsequently, on this first photoconductive layer there was formed a three-layered intermediate layer (a filtering function-having intermediate layer) by forming an about 0.8 μm phenol resin layer by dipping the first photoconductive layer in a 5% by weight methanol solution of phenol resin, coating and drying at 50° C. for 30 minutes, thereafter forming an about 1 μm-thick copper phthalocyanine filter layer on the phenol resin layer by dipping it in a 10% by weight (total solid concentration) methylene chloride solution containing 8-copper phthalocyanine and polyester in the equal ratio by weight, coating and drying at 50° C. for 10 minutes, and further forming an about 0.8 μm-thick phenol resin layer on the filter layer by dipping it again in a 5% by weight methanol solution of phenol resin, coating and drying at 50° C. for 30 minutes.

Successively, the under mentioned composition was put in tetrahydrofuran so as to attain a solid concentration of 1.5% by weight and milled for 3 hours. The resulting solution was coated on the intermediate layer and dried at 60° C. for 10 minutes to thereby form an about 0.2 μm-thick charge carrier generating layer,

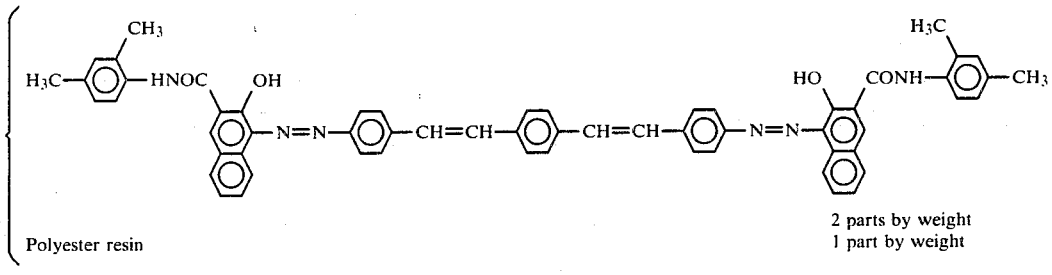

In succession, on this charge carrier generating layer there was formed an about 15 μm-thick charge transport layer by dissolving 1 part by weight of an electron donability substance having the under mentioned structural formula and 1 part by weight of polycarbonate in tetrahydrofuran so as to attain a solid concentration of 20% by weight, coating the charge carrier generating layer with the resulting solution and drying at 60° C. for 1 hour, thereby obtaining a layered second photoconductive layer,

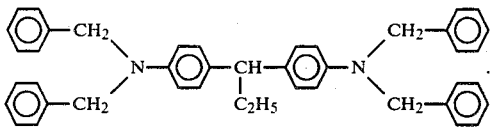

This second photoconductive layer was laminated on the intermediate layer, thereby producing a composite photosensitive element (Element 1 of the present invention).

For comparison's sake, a composite photosensitive element (Control 1) was prepared by the exactly same procedure with the exception that an about 43 μm-thick Se layer was employed in place of the Se-As layer, said Se layer being formed by vacuum-depositing Se, on a 0.2 mm-thick Al plate held at 70° C., for 20 minutes from a vapordeposition source maintained at 300° C.

The thus prepared respective photosensitive elements (samples) were subjected to −6.5 KV electrification for 5 seconds in the dark (first corona electrification), then subjected to +4.3 KV electrification for 1 second in the dark (second corona electrification). Thereafter, measurement was taken of the surface potential corresponding the black area of each sample (i') after having been left standing for 1 second in the dark which is equivalent to imagewise exposure, the surface potential corresponding to the white area thereof (ii') after having been subjected to 1 second's radiation of a 20-lux white light which is equivalent to imagewise exposure, and the surface potential corresponding to the red area thereof (iii') after having been subjected to 1 second's radiation of a 20-lux white light through a red color filter which is equivalent to imagewise exposure respectively. The results were as shown in Table 1.

As is evident from Table-1, the control photosensitive element, which does not contain As in the first photoconductive layer, does not exhibit a sufficient degree of potential decay when exposed to radiation of a red light, and consequently is difficult to obtain a high quality dichromatic copy.

TABLE 1

| | Our element 1 | Control 1 |
|---|---|---|
| (i') | −650 V | −670 V |
| (ii') | −150 V | −120 V |
| (iii') | +420 V | +270 V |

Example 2

An about 35 μm-thick Se-As layer (first photoconductive layer) was formed by vacuum-depositing a Se-As alloy (whose As content is 4% by weight) on a 0.2 mm-thick Al plate (electrically conductive substrate) held at 90° C. from a vapordeposition source maintained at 330° C. for 20 minutes. Then, an about 0.8 μm-thick intermediate layer was formed on the first photoconductive layer by dipping it in a 5% by weight methanol solution of phenol resin, coating and drying at 50° C. for 30 minutes. Successively, the undermentioned composition was put in tetrahydrofuran so as to attain a solid concentration of 1.5% by weight and milled for 5 hours. The resulting solution was coated on this intermediate layer and dried at 60° C. for 10 minutes to thereby form an about 0.3 μm-thick charge carrier generating layer.

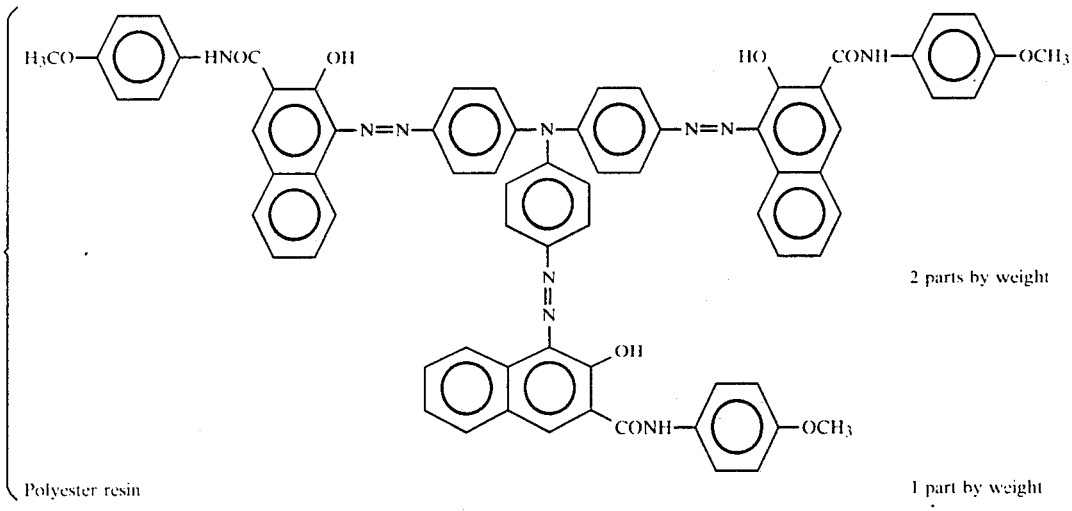

Further, on this charge carrier generating layer there was formed an about 16 μm-thick charge transport layer by coating the former layer with a solution obtained by dissolving the under mentioned composition in methylene chloride so as to attain a solid concentration of 10% by weight and vacuum-drying at 60° C. for 1 hour, whereby a layered second photoconductive layer was formed. Thus, a composite photosensitive element (Element 2 of the present invention) was prepared,

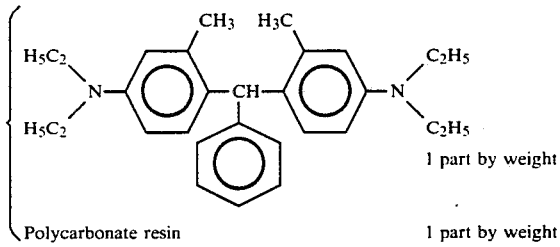

For comparison's sake, a composite photosensitive element (Control 2) was prepared by the exactly same procedure with the exception that an about 35 μm-thick Se layer was employed in place of the Se-As layer, said Se layer being formed by vacuum-depositing Se, on a 0.2 mm-thick Al plate held at 70° C., for 15 minutes from a vapordeposition source maintained at 300° C.

The thus prepared respective photosensitive elements (samples) were subjected to −6.5 Kv electrification for 5 seconds in the dark (first corona electrification), and then subjected to +4.5 KV electrification for 1 hour in the dark (second corono electrification). Thereafter, measurement was taken on the surface potential corresponding to the black area of each sample (i″) after having been left standing for 1 second in the dark which is equivalent to imagewise exposure, the surface potential corresponding to the white area thereof (ii″) after having been subjected to 1 second's radiation of a 40-lux white light which is equivalent to imagewise exposure, and the surface potential corresponding to the red area thereof (iii″) after having been subjected to 1 second's radiation of a 40-lux white light through a red colored filter which is equivalent to imagewise exposure. The thus obtained results were as shown in Table-2.

TABLE 2

| | Our element 2 | Control 2 |
|---|---|---|
| (i″) | −630 V | −680 V |
| (ii″) | −70 V | −30 V |
| (iii″) | +520 V | +350 V |

Example 3

A Se-Te-As alloy (whose Te content is 8% by weight and As content is 4% by weight and which includes 40 ppm of Cl) was vacuum-deposited on a 0.2 mm-thick Al plate (electrically conductive substrate) held at 100° C. from a vapordeposition source maintained at 350° C. for 20 minutes, thereby forming and about 50 μm-thick first photoconductive layer. Subsequently, an about 1 μm-thick intermediate layer was formed on said first photoconductive layer by dipping it in a 5% by weight methylketone solution of polyurethane, coating, leaving standing at room temperature and then exposing to the atmosphere of 30° C. and 90% RH for solidification. Further, same was dipped in a tetrahydrofuran dispersion (dispersed by means of a ball mill) of the under mentioned composition having a solid concentration of 7% by weight, coating, and dried at 50° C. for 1 hour, whereby an about 0.3 μm-thick charge carrier generating layer was formed on the intermediate layer.

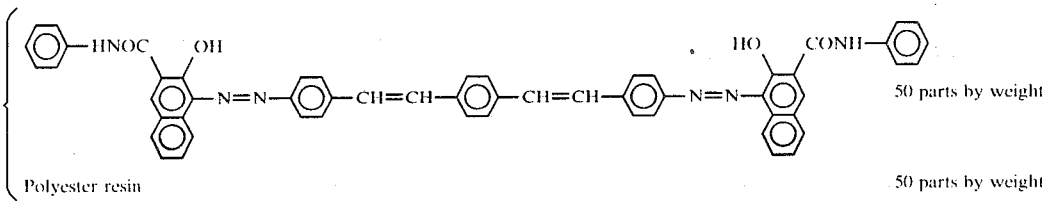

Sucessively, an about 12 μm-thick charge transport layer was formed thereon by coating same with an ethylene chloride solution of the under mentioned composition having a solid concentration of 10% by weight according to blade method and drying at 50° C. for 1 hour, thereby obtaining a layered second photoconductive layer. Thus, a composite photosensitive element (Element 3 of the present invention) was prepared,

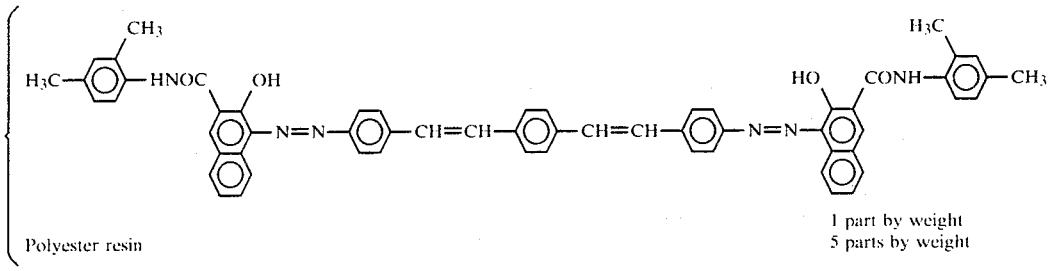

| | |
|---|---|
| Triphenylmethane | 50 parts by weight |
| Polycarbonate resin | 50 parts by weight |

The photosensitive element thus prepared according to the present invention was subjected to −6.5 KV for 5 seconds in the dark (first corona electrification), and then subjected to +4.3 KV for 0.5 second in the dark (second corona electrification). Thereafter, measurement was taken of the surface potential corresponding to the black area of the element (i''') after having been left standing for 1 second in the dark which is equivalent to imagewise exposure, the surface potential corresponding to the white area thereof (ii''') after having been subjected to 1 second's radiation of a 20-lux white light which is equivalent to imagewise exposure, and the surface potential corresponding to the red area thereof (iii''') after having been subjected to 1 second's radiation of a 20-lux white light through a red colored filter which is equivalent to imagewise exposure. The obtained results were as shown in Table-3.

TABLE 3

| | Our element 3 |
|---|---|
| (i''') | −650 V |
| (ii''') | −100 V |
| (iii''') | +390 V |

Example 4

The undermentioned composition was put in tetrahydrofuran so as to attain a solid concentration of 1.5% by weight and milled for 3 hours. The resulting solution was coated on the first photoconductive layer of Example 1 and dried at 60° C. for 10 minutes to thereby form an about 1 μm-thick charge carrier generating layer constituting a second photoconductive layer, In succession, on this charge carrier generating layer there was formed an about 15 μm-thick charge transport layer constituting said second photoconductive layer by dissolving 1 part by weight of an electron donability substance having the undermentioned structural formula and 1 part by weight polycarbonate so as to attain a solid concentration of 20% by weight, coating the charge carrier generating layer with the resulting solution and drying at 60° C. for 1 hour, whereby there was obtained a layered second photoconductive layer,

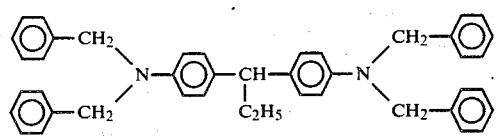

This layered second photoconductive layer was laminated on the first photoconductive layer to thereby produce a composite photosensitive element (Element 4 of the present invention).

Measurement was taken of the surface potential corresponding to each of the black, white and red areas of the thus produced photosensitive element after imagewise exposure by the same procedure as Example 1. The obtained results were as shown below:

| | Our element 4 |
|---|---|
| (i') | −710 V |
| (ii') | −160 V |
| (iii') | +280 V |

I claim:

1. A composite photosensitive element for use in electrophotography and capable of achieving dichromatic developement, which comprises: an electrically conductive substrate; a first photoconductive layer laminated on top of said substrate, said first photoconductive layer being substantially insensitive to red light, said first photoconductive layer being selected from the group consisting of (1) a vapor-deposited Se-As sub-layer consisting essentially of from 1 to 6% by weight of As and the balance is essentially Se, said Se-As sub-layer having a thickness of from 20 to 40 μm, and a vapor-deposited Se-Te sub-layer coated directly on top of said Se-As sub-layer, said Se-Te sub-layer consisting essentially of from 4 to 12% by weight of Te and the balance is essentially Se, said Se-Te sub-layer having a thickness of from 0.5 to 5μm, and (2) a vapor-deposited Se-Te-As layer consisting essentially of from 4 to 12% by weight of Te, from 1 to 4% by weight of As and the balance is essentially Se, said layer having a thickness of from 20 to 50μm; a second photoconductive layer laminated on top of said first photoconductive layer, said second photoconductive layer being permeable to light and being sensitive to red light, said second photoconductive layer comprising a charge carrier generating sub-layer consisting essentially of a photoconductive azo pigment laminated on top of said first photoconductive layer, and a charge transport sub-layer laminated on top of said charge carrier generating sub-layer, said charge carrier generating sub-layer having a thickness of from 0.01 to 1.0 μm and said charge transport sub-layer having a thickness of from 10 to 30 μm; wherein said composite photosensitive element is subjected to a first negative electrification in the dark and then to a second, positive or alternating current electrification in the dark at a lower voltage than said first electrification whereby to charge said first photoconductive layer with a positive charge and to charge said second photoconductive layer with a negative charge, then effecting imagewise exposure of said composite photosensitive element through a dichromatic original having a black area and a red area on a white background whereby to form on said composite photosensitive element an electrostatic latent image in which the surface potential of the electrostatic latent image corresponding to the black area of the original is of opposite charge relative to the surface potential of the electrostatic latent image corresponding to the red area of the original, and then developing said electrostatic latent image by applying thereto, in succession, two toners of opposite polarity and different colors, whereby to obtain a dichromatic visible image.

2. A composite photosensitive element as claimed in claim 1 in which said first photoconductive layer consists of said layer (1).

3. A composite photosensitive element as claimed in claim 1 in which said first photoconductive layer consists of said Se-Te-As layer (2).

4. A composite photosensitive element as claimed in claim 1, claim 2 or claim 3, including an intermediate layer between said first photoconductive layer and said charge carrier generating sub-layer, said intermediate layer being capable of preventing the transfer of plus electric charges and of permitting the transfer of minus electric charges in the dark.

5. A composite photosensitive element as claimed in claim 4 in which said intermediate layer consists of three sublayers and the middle sub-layer consists essentially of an azo pigment or cyan coloring matter effective for filtering red light.

6. A composite photosensitive element as claimed in claim 1 in which said charge transport sub-layer consists essentially of an electron donor.

* * * * *